US007154455B2

(12) United States Patent
Matsumoto

(10) Patent No.: US 7,154,455 B2
(45) Date of Patent: Dec. 26, 2006

(54) DISPLAY DRIVER CIRCUIT

(75) Inventor: Shoichiro Matsumoto, Ogaki (JP)

(73) Assignee: Sanyo Electric Co., Ltd. (JP)

( * ) Notice: Subject to any disclaimer, the term of this patent is extended or adjusted under 35 U.S.C. 154(b) by 455 days.

(21) Appl. No.: 10/652,804

(22) Filed: Aug. 29, 2003

(65) Prior Publication Data

US 2004/0095299 A1 May 20, 2004

(30) Foreign Application Priority Data

Aug. 30, 2002 (JP) ..... 2002-254682
Aug. 1, 2003 (JP) ..... 2003-285363

(51) Int. Cl.
*G09G 3/30* (2006.01)

(52) U.S. Cl. ..... 345/76; 345/72; 345/82; 345/98; 345/204

(58) Field of Classification Search ..... 345/204–213, 345/76–86
See application file for complete search history.

(56) References Cited

U.S. PATENT DOCUMENTS 6,570,338 B1 5/2003 Bae
6,583,775 B1 6/2003 Sekiya et al.
6,954,194 B1 * 10/2005 Matsumoto et al. ..... 345/92

OTHER PUBLICATIONS

Machio, Yamagishi "Display Device" Japanese Patent No.: JP02001147659A (Publication Date: May 29, 2001). Application No.: JP11327637 (Application Date: Nov. 18, 1999). Assignee: Sony Corp.*
Shimizu, Keiichi "Power Source" Japanese Patent No.: JP359178961A (Publication Date: Oct. 11, 1981). Application No.: JP58050383 (Application Date: Mar. 28, 1983). Assignee: Toshiba Electric Equip Corp.*
A copy of Office Action for corresponding Chinese Patent Application No. 03155959X with its English translation. A copy of Korean Patent Patent Laid-Open Publication No. 2001-77572 and its English Abstract.
A copy of Chinese Patent Publication No. 1278635A and its English Abstract.

* cited by examiner

*Primary Examiner*—Richard Hjerpe
*Assistant Examiner*—Tammy Pham
(74) *Attorney, Agent, or Firm*—Cantor Colburn LLP

(57) ABSTRACT

A gate line GL is set to an H level to switch on a selection TFT (10) and a short-circuiting TFT (16). A current corresponding to data (data current (negative)) is applied to a data line (Data). In this manner, a current corresponding to the data current flows through a voltage converter TFT (12) and a driver TFT (14) and light is emitted from an organic EL element (50). A gate voltage of the voltage converter TFT (12) and the driver TFT (14) in this process is stored in a storage capacitor (C). Even after the data current is switched off and the selection TFT (10) and the short-circuiting TFT (16) are switched off, the driver TFT (14) continues to apply a current. After a predetermined emission period elapses, an erase line (ESL) is driven to switch an erase TFT (18) on to discharge the storage capacitor (C) and switch the driver TFT (14) off.

12 Claims, 9 Drawing Sheets

DISPLAY DRIVER CIRCUIT

BACKGROUND OF THE INVENTION

1. Field of the Invention

The present invention relates to a display driver circuit having a driver transistor for supplying a current from a power supply to an electroluminescence elements and which controls light emission of the electroluminescence element by controlling the driver transistor.

2. Description of the Related Art

Because electroluminescence (hereinafter simply referred to as "EL") display devices in which a self-emitting EL element is used as an emissive element in each pixel have advantages such as that the device is thin, self-emitting, and consumes less power, EL display devices have attracted much attention as alternatives to display devices such as liquid crystal display (LCD) and cathode ray tube (CRT) display devices.

In particular, a high resolution display can be achieved by an active matrix EL display device in which a switching element such as a thin film transistor (hereinafter simply referred to as "TFT") for individually controlling an EL element is provided in each pixel and the EL element in each pixel.

In an active matrix EL display device, a plurality of gate lines extend along a row direction over a substrate, a plurality of data lines and power supply lines extend along a column direction over the substrate, and each pixel has an organic EL element, a selection TFT, a driver TFT, and a storage capacitor. In this structure, a gate line is selected so that the selection TFT is switched on, a data voltage on a data line is charged into the storage capacitor, and the driver TFT is switched on by this data voltage to allow electric power to flow from a power supply line through the organic EL element.

Japanese Patent Laid-Open Publication No. 2001-147659 discloses a circuit in which two p-channel TFTs are added in each pixel as controller transistors and a signal current is applied to a data line.

FIG. 4 shows a pixel circuit disclosed in Japanese Patent Laid-Open Publication No. 2001-147659. As shown, one terminal of an n-channel TFT (selection TFT) 3 having its gate connected to a scan line scanA is connected to a data line data onto which a current Iw is to be applied. The other terminal of the selection TFT 3 is connected to one terminal of a p-channel TFT 1 and one terminal of a p-channel TFT (driver TFT) 4. The other terminal of the TFT 1 is connected to a power supply line Vdd and a gate of the TFT 1 is connected to a gate of a p-channel TFT 2 for driving an organic EL element ("OLED"). The other terminal of the TFT 4 is connected to the gates of the TFTs 1 and 2 and a gate of the TFT 4 is connected to a scan line scanB.

In this structure, the scanA is set to an H level to switch the TFT 3 on and scanB is set to a L level to switch the TFT 4 on. A current Iw corresponding to data is applied to data, which causes the gate and source of the TFT 1 to be short-circuited, the current Iw is converted to a voltage, and voltages of the gates of the TFTs 1 and 2 are set to this voltage. After the TFTs 3 and 4 are switched off, the gate voltage of the TFT 2 is maintained by a capacitor C, thus allowing a current corresponding to the current Iw to flow through the TFT 2 and through an organic EL (OLED) so that light is emitted from the OLED. Then, when scanB is set to an L level, the TFT 1 is switched on, the gate voltage of TFT 1 is increased, the capacitor C is discharged, data is erased, and the TFTs 1 and 2 are switched off.

With this circuit, when a current flows through the TFT 1, the current is converted to a voltage and the gate voltage is determined. According to the determined gate voltage, the amount of current flowing through the TFT 2 is determined. Thus, the amount of current flowing through the TFT 2 can be set corresponding to a signal current Iw.

This circuit, however, requires a scan line scanB for controlling the TFT 4 and the scan line scanB must be driven both when data is written and when data is erased.

In particular, when data is written, both lines scanA and scanB must be driven which results in a heavier load for the driver. In addition, in the erasure process, the TFT 4 is switched on to increase the gate voltage of the TFT 1 , but because the gate voltage is increased via the TFT 1 , there is a problem in that the gate voltage sometimes does not sufficiently increase. In this case, some amount of current continues to flow through the TFT 2 , causing a problem in that black cannot be sufficiently displayed.

SUMMARY OF THE INVENTION

The present invention advantageously reduces load to a power supply and to a driver and realizes a reliable black display.

According to one aspect of the present invention, a gate voltage of a voltage converter transistor is determined when a current corresponding to data on a data line (data current) flows through the voltage converter circuit and an amount of current through a driver transistor is determined corresponding to the gate voltage. Because the impurity concentrations of the voltage converter transistor and the driver transistor can be set to approximately equal values, the amount of current flowing through the driver transistor can be set corresponding to the data current through a ratio of sizes of gates of the voltage converter transistor and of the driver transistor. This structure has an advantage that effects of variations in characteristics of transistors throughout a panel can be eliminated and a uniform display can be achieved. In addition, when the data current is read from the data line, it is required to drive the gate line (and a line for supplying a write timing signal) only, resulting in an advantage that load to the power supply and to the driver can be reduced. Moreover, because the gate voltage of the driver TFT can be reliably set to the power supply voltage using an erase line, it is possible to reliably switch the driver off and achieve black display by the organic EL element 50.

DESCRIPTION OF PREFERRED EMBODIMENTS

Preferred embodiments of the present invention will now be described with reference to the drawings.

Figure 1:
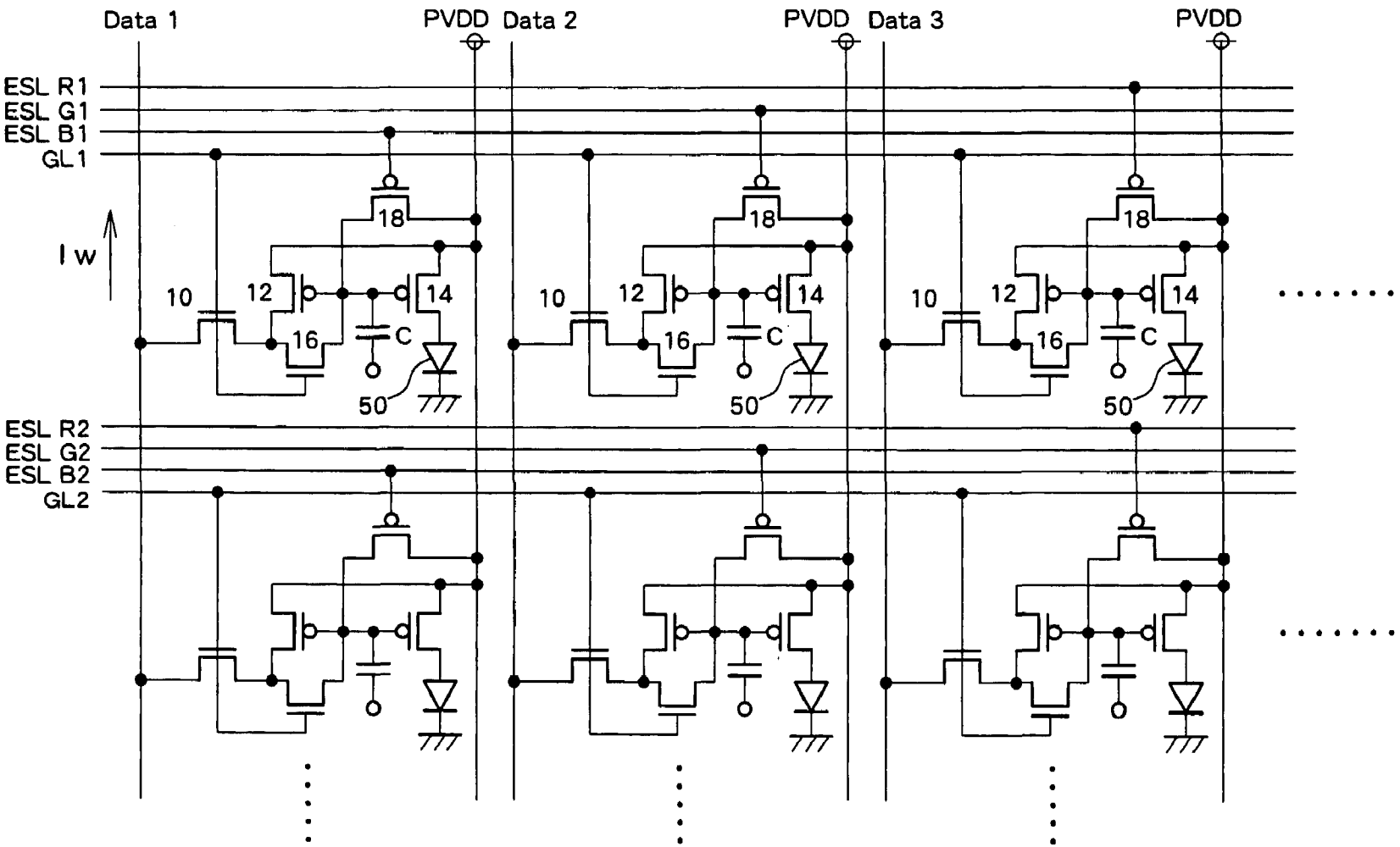
FIG. 1 is a diagram showing a structure according to a preferred embodiment of the present invention.

FIG. 1 is a diagram showing a structure according to a preferred embodiment of the present invention and shows a circuit structure of each pixel in an active matrix EL display device of m rows and n columns. A set of four lines, gate line GL and three erase scan lines ESLR, ESLG, and ESLB for each of R, G, and B, extends over a substrate along the row direction of the substrate for each division of pixels, and a set of two lines, a data line Data and a power supply line PVDD, extends over the substrate along the column direction of the substrate for each division of pixels. In this structure, the gate line GL is connected to a TFT of each pixel at the upper side of the pixel, one of the erase scan lines ESLR, ESLG, and ESLB is connected to a TFT of the pixel at the upper side of the pixel, a data line Data is connected to a TFT of the pixel at the left side of the pixel, and a power supply line PVDD is connected to TFTs of the pixel at the right side of the pixel. In FIG. 1, the first column from the left is blue (B), the second column from the left is green (G), and the third column from the left is red (R). For the pixels in each column, one of the erase lines ESLB, ESLG, and ESLR is connected.

Each pixel includes three p-channel TFTs, two n-channel TFTs, and a storage capacitor C in addition to an organic EL element 50.

An n-channel selection TFT 10 has a drain connected to the data line Data, a gate connected to a gate line GL, and a source connected to a drain of a p-channel voltage converter TFT 12. A source of the voltage converter TFT 12 is connected to a power supply line PVDD and a gate of the voltage converter TFT 12 is connected to a gate of a driver TFT 14. In addition, a source of an n-channel short-circuiting TFT 16 is connected to the drain of the voltage converter TFT 12, a drain of the short-circuiting TFT 16 is connected to the gate of the voltage converter TFT 12, and a gate of the short-circuiting TFT 16 is connected to the gate line GL similar to the selection TFT 10.

A source of the driver TFT 14 is connected to the power supply line PVDD, and a drain of the driver TFT 14 is connected to an anode of the organic EL element 50. A cathode of the organic EL element 50 is connected to the ground. When the driver TFT 14 is switched on, current flows through the organic EL element 50, which causes light to be emitted from the organic EL element 50.

A drain of a p-channel erase TFT 18 which has a source connected to the power supply line PVDD is connected to the gates of the voltage converter TFT 12 and of the driver TFT 14. A gate of the erase TFT 18 is connected to one of the erase lines ESL depending on the color of the pixel. In a pixel at the upper left of FIG. 1 (leftmost column), the gate of the erase TFT 18 is connected to an erase line ESLB (blue) as shown.

One terminal of a storage capacitor C having the other terminal connected to the power supply line PVDD is connected to the gates of the voltage converter TFT 12 and of the driver TFT 14.

In this structure, when it is desired that a certain pixel emit light, a gate line corresponding to the row of the pixel is set to an H level so that the selection TFT 10 and the short-circuiting TFT 16 of the pixel are switched on, and a data current Iw corresponding to data is applied to the data line.

Then, the gate and drain of the voltage converter TFT 12 are short-circuited by the short-circuiting TFT 16 becoming an H level and the data current Iw flows through the voltage converter TFT 12. Because the voltage converter TFT 12 and the driver TFT 14 form a current mirror, the data current Iw also flows through the driver TFT 14. It is possible in this structure to change gate sizes of the voltage converter TFT 12 and of the driver TFT 14 so that a current corresponding to a ratio of the gate sizes flows through the driver TFT 14.

The organic EL element 50 emits light when holes injected from the anode and electrons injected from the cathode recombine within an emissive layer to excite emissive molecules and the emissive molecules return from the excited state to the ground state. The emission brightness of the organic EL element 50 is approximately proportional to a current supplied to the organic EL element 50. By applying a current corresponding to the data current Iw determined for each pixel through the organic EL element 50, light is emitted from the organic EL element with a brightness corresponding to the data signal and a desired image display can be achieved by the overall display device.

In this process, the gate voltage of the voltage converter TFT 12 and of the driver TFT 14 is set to a value corresponding to the data current Iw and the storage capacitor C is charged to that voltage (a voltage which is relatively low compared to the voltage PVDD). When the current flowing through the data line Data is stopped and the gate line GL becomes an L level after the termination of the current on the data line Data, the selection TFT 10, the short-circuiting TFT 16, and the voltage converter TFT 12 are switched off. Because the gate voltage of the voltage converter TFT 12 and of the driver TFT 14 is maintained by the storage capacitor C, the same current continues to flow and the organic EL element 50 continues to emit light.

After the elapse of a predetermined emission time, the erase line ESL (for example, ESLB) is set to an L level, which causes the erase TFT 18 to be switched on, both terminals of the storage capacitor C to be connected to the power supply line PCDD, and the storage capacitor C to be discharged. The gate of the driver TFT 14 becomes PVDD and the driver TFT 14 is switched off. In this manner, light emission from the organic EL element 50 is terminated.

Each gate line GL is switched on in sequence, one at a time, in a display period of one frame, which causes the selection TFTs 10 and the short-circuiting TFTs 16 of the row and connected to the gate line GL to be switched on. As the gate line GL is maintained in this condition, each data line Data is driven in sequence, one at a time. In other words, a data current Iw corresponding to display data (brightness data) is applied to one data line Data which is driven, which causes a current to flow through the voltage converter TFT 12 and driver TFT 14 of the pixel connected to the data line Data on which the data current Iw flows and the organic EL elements 50 of the pixel to start emitting light. When the data current Iw flows, a corresponding voltage is stored in the storage capacitor C and the current through the driver TFT 14 is maintained even after the data current Iw is stopped. In addition, even when the gate line GL becomes an L level and the selection TFT 10 and the short-circuiting TFT 16 are switched off, the current continues to flow through the driver TFT 14.

As described above, when the erase line ESL to which the erase TFT 18 is connected is set to the L level, the driver TFT 14 is switched off. The erase lines ESLR, ESLG, and ESLB are set to the L level at different timings. With this structure, emission times for R, G, and B are controlled based on the difference in color. That is, the period in which an organic EL element of a pixel can emit light is the period within one frame until the corresponding gate line GL next becomes the H level (a period of one frame). In this embodiment, the erase line ESLG (green) is first set to the L level, then the erase line ESLB (blue) is set to the L level, and the erase line ESLR (red) is set to the L level, and the light emission from the pixels is stopped. In this manner, the emission times for different colors are set to different lengths of time, which accommodates the different emission efficiencies of the different colors. By setting different time periods, it is possible to achieve a balance among the colors and set the white balance of light emission. Therefore, the emission area of a pixel may be identical for all colors in this embodiment. Because the emission efficiency depends on the light emitting material, the emission time period can be set corresponding to the emission efficiencies of the colors used in the display device.

Figure 5:
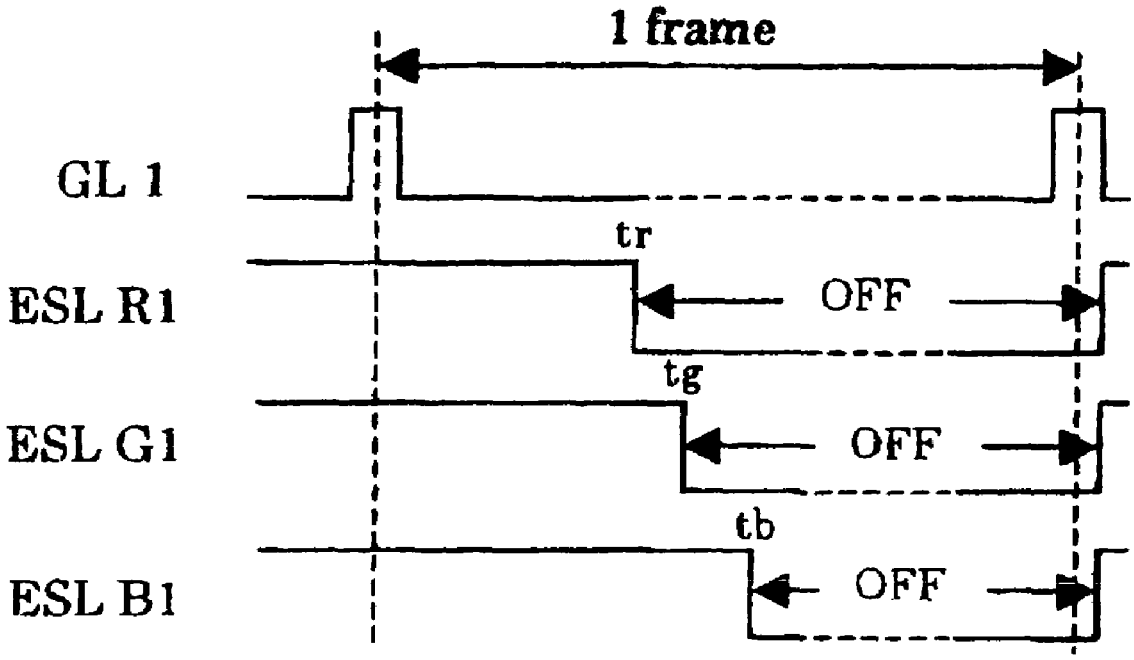
FIG. 5 is a timing chart showing operations in the embodiment shown in FIG. 1.

FIG. 5 shows a timing chart showing timings of the gate line GL1, and three erase lines, ESLR1, ESLG1, and ESLB1. As shown, the gate line GL1 becomes the H level for a predetermined period within each frame. The three erase lines ESLR1, ESLG1, and ESLB1 transitions to the H level at the timing when the gate line GL1 transitions from the H level to the L level, switch the erase TFTs 18 off, and transitions to the L level at different timings to switch the erase TFTs 18 on to execute the erase process. In this embodiment, the three erase lines ESLR1, ESLG1, and ESLB1 sequentially transition to the L level in this order, and, thus, the red pixel has the shortest emission period, the green pixel has an intermediate emission period, and the blue pixel has the longest emission period.

In this manner, according to this embodiment, the gate voltage of the voltage converter TFT 12 is determined by the data current Iw on the data line Data flowing through the voltage converter TFT 12 and the amount of current through the driver TFT 14 is determined corresponding to the gate voltage. Because approximately equal impurity concentration or the like can be achieved for the voltage converter TFT 12 and for the driver TFT 14, the amount of current through the driver TFT 14 can be set corresponding to the signal data current Iw through a ratio of the gate sizes between the voltage converter TFT 12 and the driver TFT 14. Because of this, an advantage can be obtained in that it is possible to remove influences of variation in characteristics of TFTs throughout the panel and to achieve a uniform display. In addition, when data is to be read from the data line Data, it is only necessary to drive just the gate line GL, which reduces the load on the power supply and the driver. Moreover, because the voltage on the gate of the driver TFT 14 can be reliably increased to the power supply voltage PVDD using the erase line ESL, it is possible to reliably switch the driver TFT 14 off and achieve a black display of the organic EL element 50.

Figure 2:
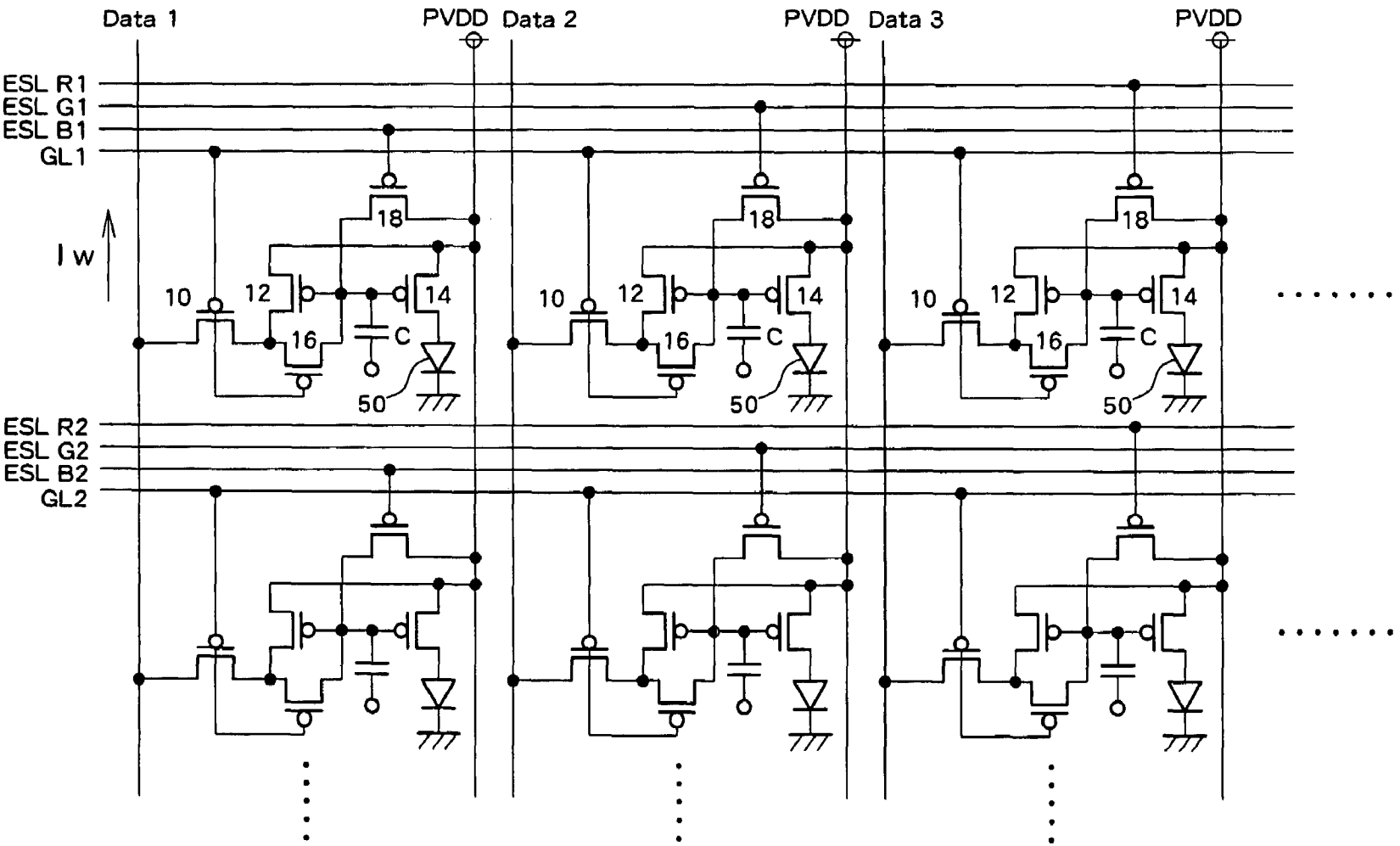
FIG. 2 is a diagram showing a structure according to another preferred embodiment of the present invention.

FIG. 2 is a diagram showing a structure according to another preferred embodiment of the present invention. In this embodiment, the selection TFT 10 and the short-circuiting TFT 16 are formed of p-channel TFTs. When a gate line GL is set to an L level, this gate line GL is selected and corresponding selection TFT 10 and short-circuiting TFT 16 are switched on. Otherwise, the operations of the structure of this embodiment are identical to those of the above-described embodiment.

In this structure, all of the TFTs are of the p-channel type. Thus, this structure allows formation of the TFTs on the substrate through the same processes, which consequently allows for reduction in the number of masks used in the processes and reduction in cost. When this structure is employed, it is preferable that all TFTs in a peripheral circuit, such as a driver circuit provided in the periphery of the pixel region, be formed of a p-channel TFT.

Figure 3:
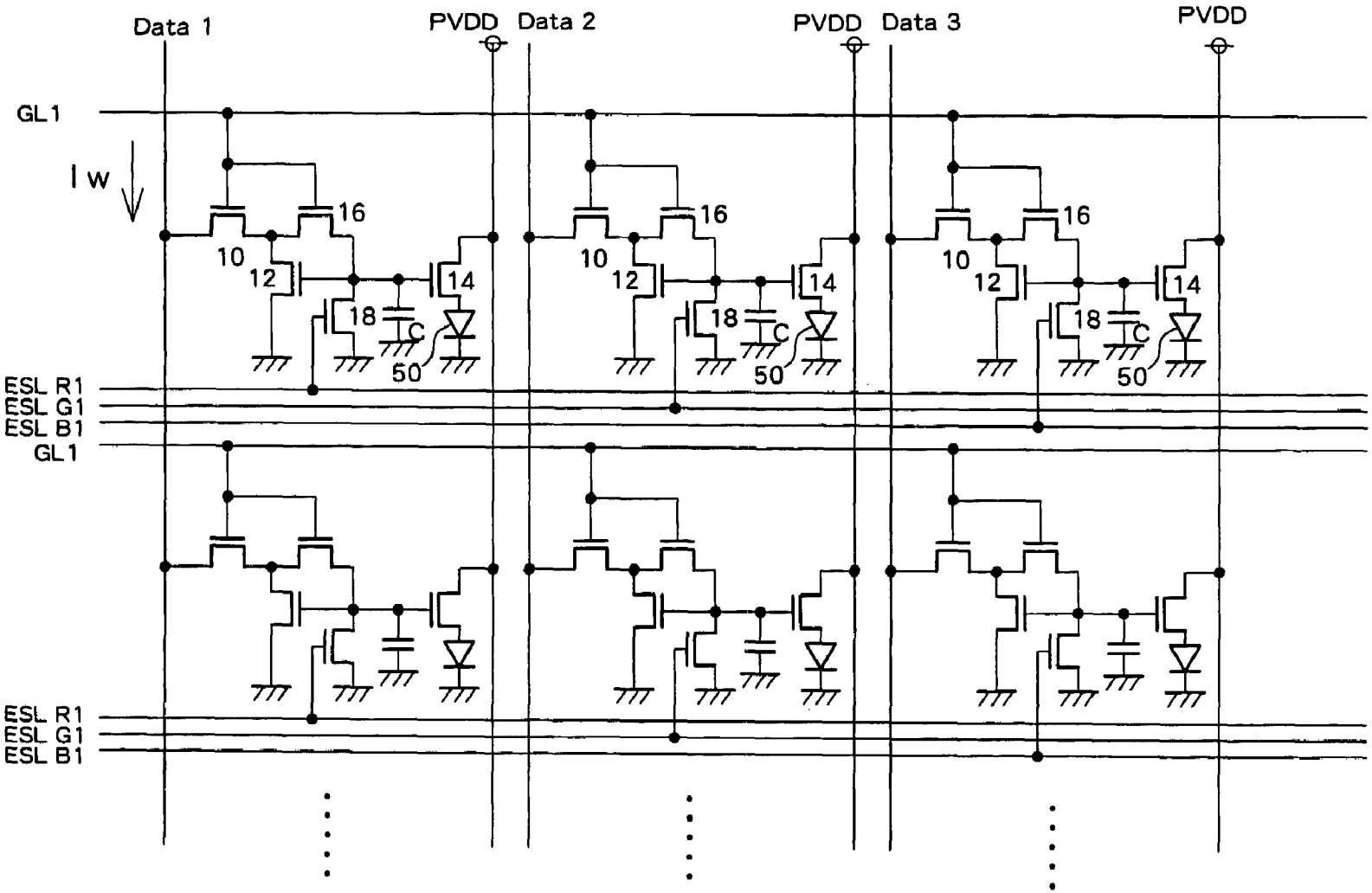
FIG. 3 is a diagram showing a structure according to yet another preferred embodiment of the present invention.
Figure 4:
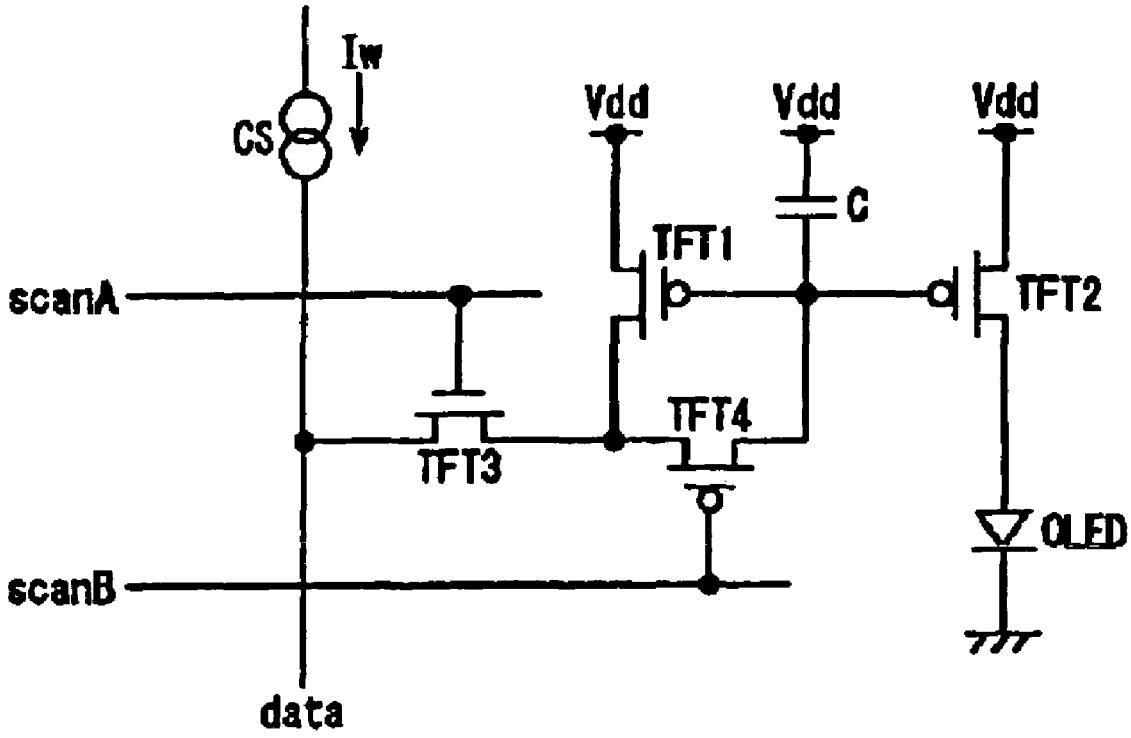
FIG. 4 is a diagram showing a conventional structure.

FIG. 3 is a diagram showing a structure according to another preferred embodiment of the present invention. As shown, in this embodiment, all of a selection TFT 10, a voltage converter TFT 12, a driver TFT 14, a short-circuiting TFT 16, and an erase TFT 18 are formed of an n-channel TFT. A source of the voltage converter TFT 12 and a source of the erase TFT 18 are both connected to the ground and the other terminal of the storage capacitor C is also connected to ground. The data line Data outputs a data current which is a predetermined current corresponding to data when the data line Data is selected.

Therefore, when a data current Iw is applied to the data line Data while the gate line GL is selected and at an H level, the data current Iw flows through the voltage converter TFT 12 and a current corresponding to the data current Iw flows through the driver TFT 14. The gate voltage of the voltage converter TFT 12 is stored in the storage capacitor C and the current for driving the organic EL element 50 which flows through the driver TFT 14 is determined. As described, this structure is identical to the above-described embodiments except that the reference when the gate voltage is set by the voltage converter TFT 12 is a voltage with respect to the ground.

In this structure, all TFTs are of the n-channel type, which allows for manufacturing of all TFTs on a substrate through common processes, which consequently enables reduction of the number of masks and, therefore, costs. When this structure is to be employed, it is preferable that all TFTs of a peripheral circuit such as a driver circuit provided in the periphery of the pixel region be formed of an n-channel TFT.

It is also possible to employ a configuration opposite to that of the embodiment shown in FIG. 1. That is, it is possible to use a p-channel TFT as the selection TFT 10 and short-circuiting TFT 16 and an n-channel TFT as the voltage converter TFT 12, driver TFT 14, and erase TFT 18. When this configuration is employed, it is possible to use the structure of FIG. 3 with the polarity of the gate line GL reversed.

In the above embodiments, three erase lines ESL are provided, one for each of R, G, and B, in order to achieve a full-color display in which the display period is changed depending on the color. It is also possible to employ a structure wherein the white balance is achieved through other methods such as, for example, changing the emission areas of pixels or employ a structure which uses white light emission with one erase line ESL wherein all erase TFTs 18 are connected to the erase line ESL. Even when a white light emitting material is used as the EL element 50, a full-color display can be achieved by providing color filters.

Figure 6:
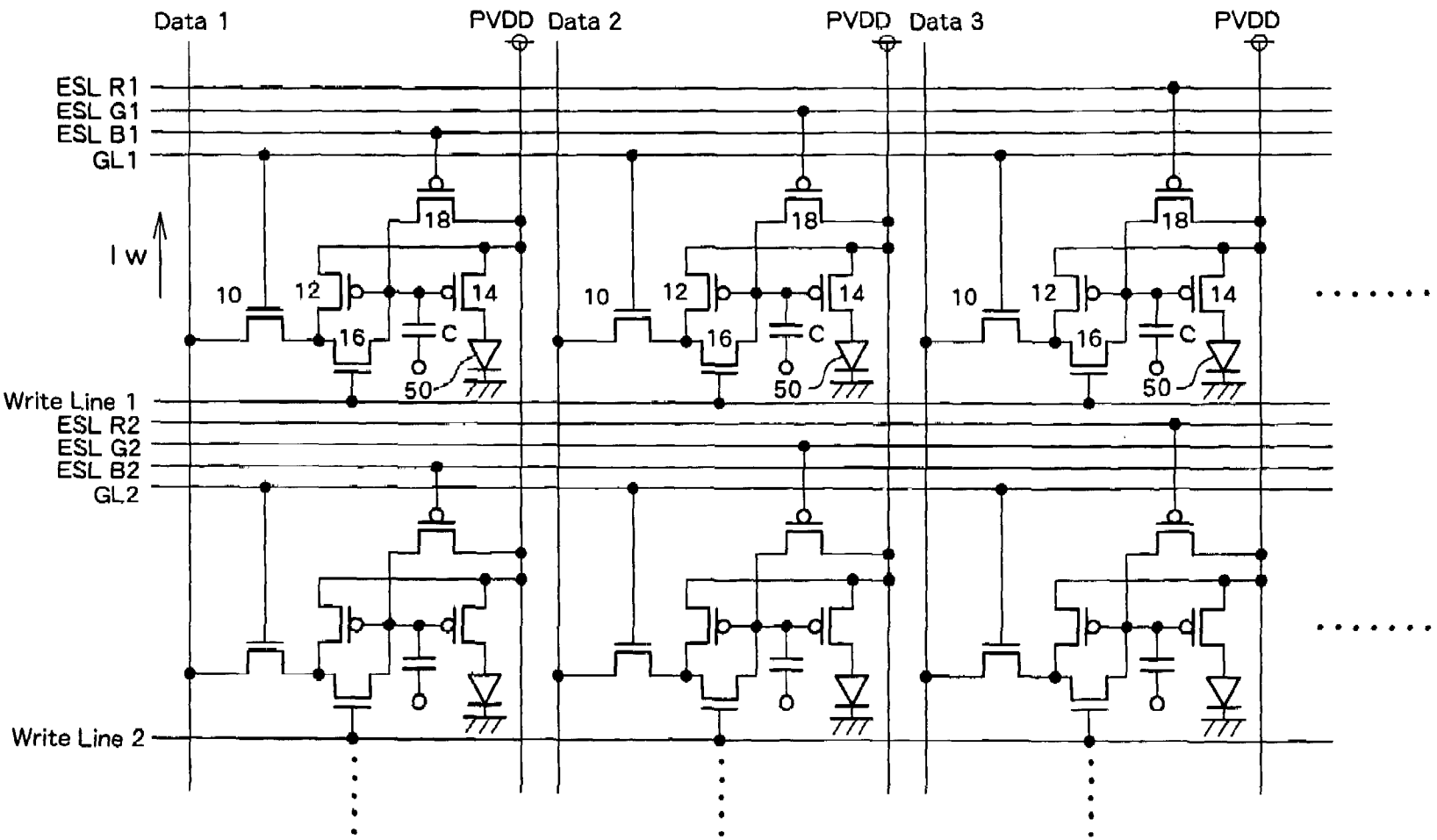
FIG. 6 is a diagram showing a structure according to another preferred embodiment of the present invention.

FIG. 6 shows a structure of another preferred embodiment wherein a dedicated write line WriteLine is connected to the short-circuiting TFT 16 of FIG. 1 in place of the gate line GL. More specifically, in the structure of FIG. 6, a write line WriteLine is provided in parallel to each gate line GL and a gate of a short-circuiting TFT 16 of each pixel on that row is connected to the write line WriteLine.

With this structure, the level of the write line WriteLine can be controlled independently from the timing of the selection of the gate line GL.

Figure 7:
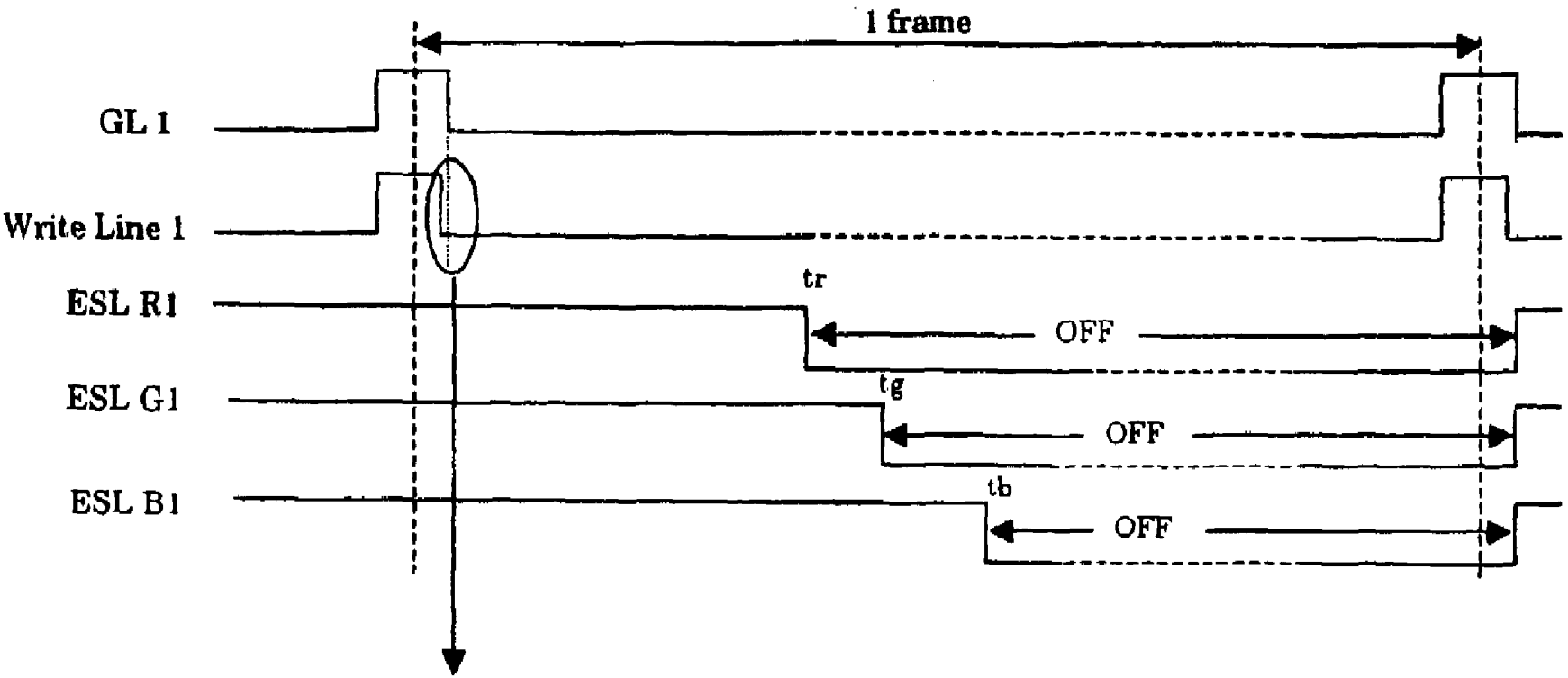
FIG. 7 is a timing chart showing operations in the embodiment shown in FIG. 6.

FIG. 7 shows a timing chart for a gate line GL1, a write line WriteLine1, and erase lines ESLR1, ESLG1, and ESLB1. In this illustrated example configuration, the gate line GL1 and the write line WriteLine1 rise simultaneously and the write line WriteLine1 falls before the gate line GL1. Because of this, the short-circuiting TFT 16 is switched off after the selection TFT 10 is switched off, which allows for reliable prevention of discharge of the data voltage stored in the capacitor C.

Figure 8:
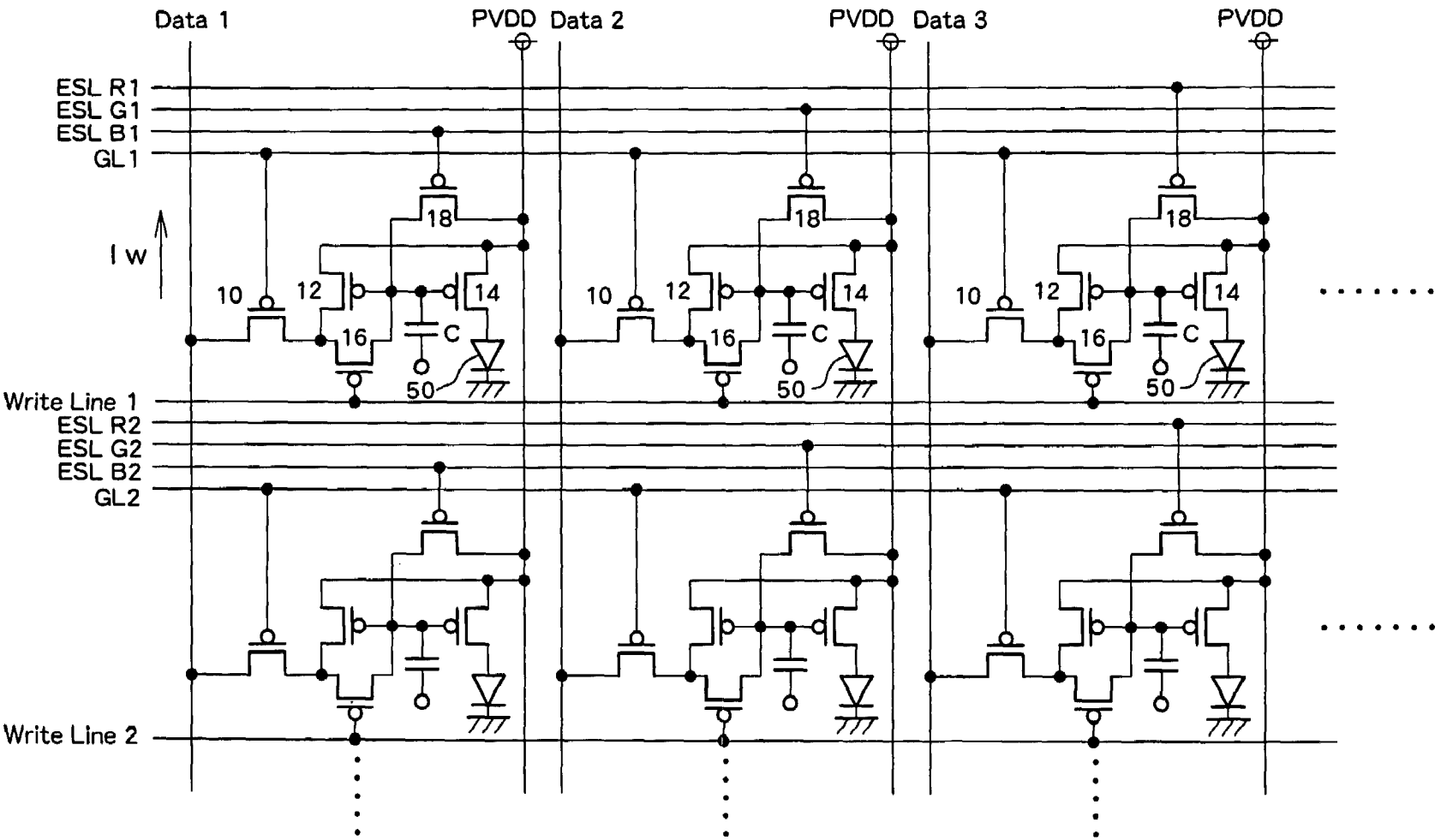
FIG. 8 is a diagram showing a structure according to another preferred embodiment of the present invention.
Figure 9:
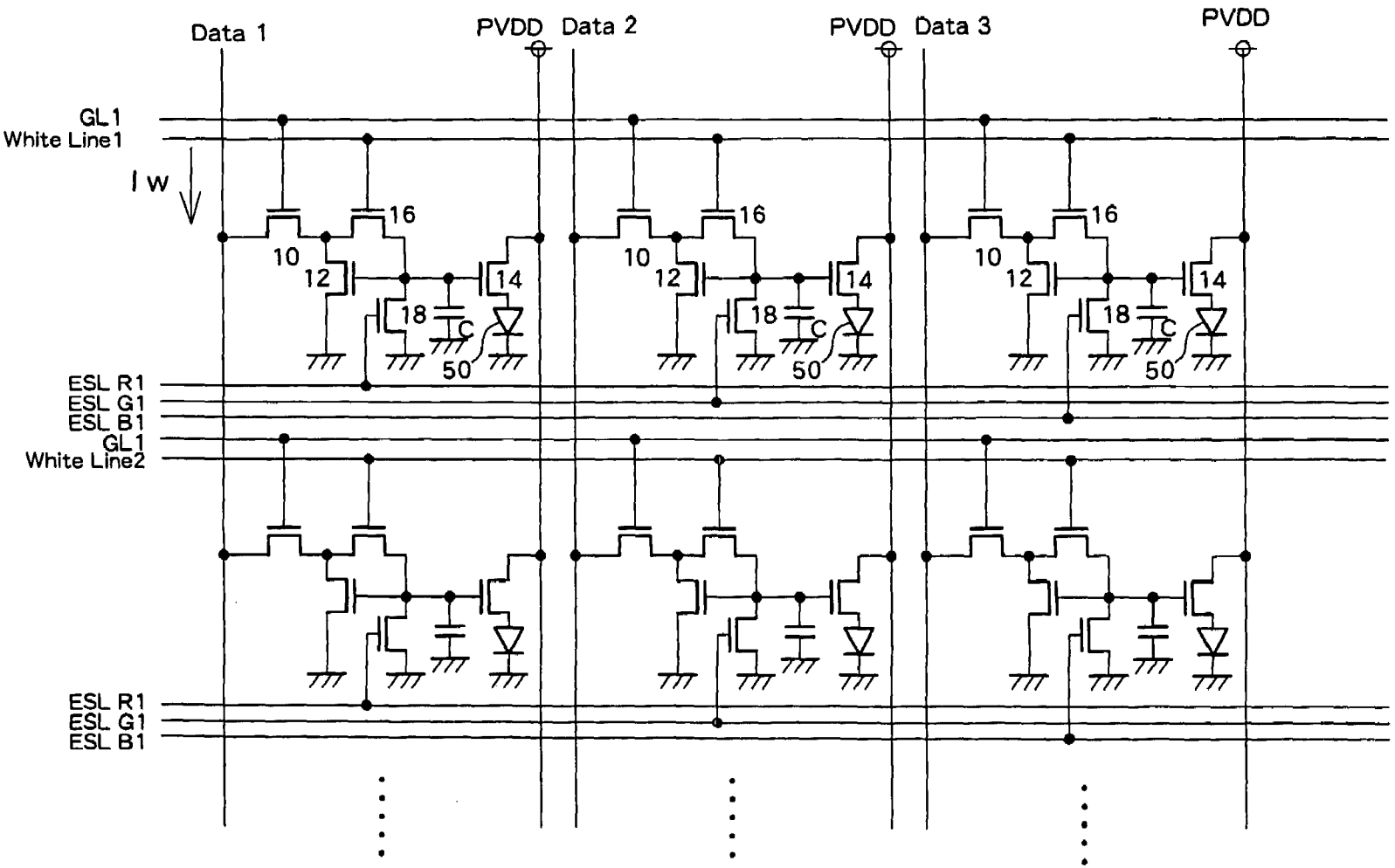
FIG. 9 is a diagram showing a structure according to another preferred embodiment of the present invention.

FIG. 8 shows a structure corresponding to the structure of FIG. 2, wherein all TFTs in the pixel circuit are made of a p-channel TFT. FIG. 9 shows a structure corresponding to the structure of FIG. 3, wherein all TFTs in the pixel circuit are made of an n-channel TFT. These structures can also operate in a manner similar to the above-described embodiments.

What is claimed is:

1. A display driver circuit having a driver transistor for supplying a current from a power supply to an electroluminescence element, for controlling the driver transistor to control light emission of the electroluminescence element, the display driver circuit comprising:

a data line driven by a current corresponding to data related to an amount of light emission;

a gate line driven by a selection signal for selecting an electroluminescence element which is to emit light;

a selection transistor having one terminal connected to the data line and a gate connected to the gate line;

a voltage converter transistor having one terminal connected to the other terminal of the selection transistor, the other terminal connected to a power supply, and a gate connected to the gate of the driver transistor;

a short-circuiting transistor connecting the other terminal of the selection transistor and the gate of the voltage converter transistor and having a gate connected to the gate line;

an erase transistor having one terminal connected to the gate of the driver transistor, the other terminal connected to the power supply, and a gate connected to an erase line; and a capacitor for storing a voltage, connected to the gate of the driver transistor, wherein the data line is driven with a current corresponding to data and the gate line is driven so that the selection transistor and the short-circuiting transistor are switched on and the current corresponding to the data flows through the voltage converter transistor to charge the capacitor to a voltage corresponding to the data, a current corresponding to the charged voltage of the capacitor is applied to the electroluminescence element through the driver transistor, and, after a predetermined emission period has elapsed, the erase line is driven to switch the erase transistor on so as to discharge the capacitor.

2. A circuit according to claim 1, wherein the driver transistor, the voltage converter transistor, and the erase transistor are p-channel transistors and the selection transistor and the short-circuiting transistor are n-channel transistors.

3. A circuit according to claim 1, wherein the driver transistor, the voltage converter transistor, the erase transistor, the selection transistor, and the short-circuiting transistor are n-channel transistors.

4. A circuit according to claim 1, wherein the driver transistor, the voltage converter transistor, the erase transistor, the selection transistor, and the short-circuiting transistor are p-channel transistors.

5. A circuit according to claim 1, wherein the driver transistor, the voltage converter transistor, the erase transistor, the selection transistor, and the short-circuiting transistor are provided for each pixel corresponding to the electroluminescence element provided for each pixel, the pixels are arranged in a matrix form, the gate line is arranged along the row direction, and the data lien is arranged along the column direction.

6. A display driver circuit having a driver transistor for supplying a current from a power supply to an electroluminescence element, for controlling the driver transistor to control light emission of the electroluminescence element, the display driver circuit comprising:

a data line driven by a current corresponding to data related to an amount of light emission;

a gate line driven by a selection signal for selecting an electroluminescence element which is to emit light;

a selection transistor having one terminal connected to the data line and a gate connected to the gate line;

a voltage converter transistor having one terminal connected to the other terminal of the selection transistor, the other terminal connected to a power supply, and a gate connected to the gate of the driver transistor;

a short-circuiting transistor connecting the other terminal of the selection transistor and the gate of the voltage converter transistor and for receiving a write timing signal on its gate;

an erase transistor having one terminal connected to the gate of the driver transistor, the other terminal connected to the power supply, and a gate connected to an erase line; and a capacitor for storing a voltage, connected to the gate of the driver transistor, wherein the data line is driven with a current corresponding to data and the gate line is driven to switch the selection transistor on and the short-circuiting transistor is switched on by a write timing signal so that the current corresponding to the data flows through the voltage converter transistor to charge the capacitor to a voltage corresponding to the data, a current corresponding to the charged voltage of the capacitor is applied to the electroluminescence element through the driver transistor, and, after a predetermined emission period has elapsed, the erase line is driven to switch the erase transistor on so as to discharge the capacitor.

7. A circuit according to claim 6, wherein the write timing signal transitions to a write level simultaneously with the selection by the selection signal and transitions to a non-write level before the end of a period in which the selection signal continues to be in the selection condition.

8. A circuit according to claim 6, wherein the write timing signal is supplied from a write line provided along with the gate line.

9. A circuit according to claim 6, wherein the driver transistor, the voltage converter transistor, and the erase transistor are p-channel transistors and the selection transistor and the short-circuiting transistor are n-channel transistors.

10. A circuit according to claim 6, wherein the driver transistor, the voltage converter transistor, the erase transistor, the selection transistor, and the short-circuiting transistor are n-channel transistors.

11. A circuit according to claim 6, wherein the driver transistor, the voltage converter transistor, the erase transistor, the selection transistor, and the short-circuiting transistor are p-channel transistors.

12. A circuit according to claim 6, wherein the driver transistor, the voltage converter transistor, the erase transistor, the selection transistor, and the short-circuiting transistor are provided for each pixel corresponding to the electroluminescence element provided for each pixel, the pixels are arranged in a matrix form, the gate line is arranged along the row direction, and the data lien is arranged along the column direction.

* * * * *